US011851954B2

(12) United States Patent
Johnsen

(10) Patent No.: US 11,851,954 B2
(45) Date of Patent: Dec. 26, 2023

(54) RISER ASSEMBLY

(71) Applicant: MHWIRTH AS, Kristiansand (NO)

(72) Inventor: John Magne Johnsen, Stabekk (NO)

(73) Assignee: MHWIRTH AS, Kristiansand (NO)

( * ) Notice: Subject to any disclaimer, the term of this patent is extended or adjusted under 35 U.S.C. 154(b) by 0 days.

(21) Appl. No.: 18/010,211

(22) PCT Filed: Jun. 4, 2021

(86) PCT No.: PCT/NO2021/050142

§ 371 (c)(1),
(2) Date: Dec. 14, 2022

(87) PCT Pub. No.: WO2021/256937

PCT Pub. Date: Dec. 23, 2021

(65) Prior Publication Data

US 2023/0243218 A1 Aug. 3, 2023

(30) Foreign Application Priority Data

Jun. 16, 2020 (GB) ..... 2009102

(51) Int. Cl.
*E21B 17/01* (2006.01)

(52) U.S. Cl.
CPC ..... *E21B 17/01* (2013.01)

(58) Field of Classification Search
CPC ..... E21B 17/01; E21B 17/085; E21B 17/0853
See application file for complete search history.

(56) References Cited

U.S. PATENT DOCUMENTS

| | | | | |
|---|---|---|---|---|
| 4,043,575 | A | 8/1977 | Roth | |
| 4,280,719 | A | 7/1981 | Daniel et al. | |
| 4,487,434 | A | 12/1984 | Roche | |
| 5,634,671 | A | 6/1997 | Watkins | |
| 7,762,337 | B2 * | 7/2010 | Papon | E21B 17/0853 166/345 |
| 10,704,341 | B2 * | 7/2020 | Persent | E21B 17/046 |
| 2011/0203804 | A1 * | 8/2011 | Guesnon | E21B 17/085 285/363 |

(Continued)

FOREIGN PATENT DOCUMENTS

| | | |
|---|---|---|
| DE | 28 33 866 A1 | 2/1980 |
| GB | 2 320 541 A | 6/1998 |
| WO | WO 2011/104629 A1 | 9/2011 |

*Primary Examiner* — Matthew R Buck
(74) *Attorney, Agent, or Firm* — Norman B. Thot

(57) ABSTRACT

A riser assembly includes a riser with a first and second riser joint, an auxiliary line, and a first and second flange. The auxiliary line has an auxiliary line joint which connects a first and second auxiliary line section. The auxiliary line joint has a first joint assembly connected to the first auxiliary line section, and a second joint assembly connected to the second auxiliary line section. The first and second joint assembly each have a bearing surface. A bearing surface of the first flange engages the bearing surface of the first joint assembly. A bearing surface of the second flange engages the bearing surface of the second joint assembly. The bearing surface of the first flange or of the first joint assembly also has a rocker formation which contacts the bearing surfaces of the first flange and of the first joint assembly while permitting a relative angular movement therebetween.

13 Claims, 8 Drawing Sheets

(56) References Cited

U.S. PATENT DOCUMENTS

| | | | | |
|---|---|---|---|---|
| 2011/0209878 | A1 | 9/2011 | Guesnon | |
| 2013/0020087 | A1* | 1/2013 | Guesnon | E21B 17/085 166/367 |
| 2014/0151058 | A1* | 6/2014 | Weir | E21B 17/085 166/355 |
| 2016/0258562 | A1 | 9/2016 | Bjoerneklett et al. | |

* cited by examiner

RISER ASSEMBLY

CROSS REFERENCE TO PRIOR APPLICATIONS

This application is a U.S. National Phase application under 35 U.S.C. § 371 of International Application No. PCT/NO2021/050142, filed on Jun. 4, 2021 and which claims benefit to Great British Patent Application No. 2009102.1, filed on Jun. 16, 2020. The International Application was published in English on Dec. 23, 2021 as WO 2021/256937 A1 under PCT Article 21(2).

FIELD

The present invention relates to a riser assembly, in particular to a riser assembly having a riser connector which provides support for at least one auxiliary flow line which extends along the exterior of and parallel to the riser.

BACKGROUND

A riser, for example, a riser which surrounds the drill string in a subsea drilling operation, is made up of a plurality of tubular sections (which are often referred to as riser joints), the adjacent ends of which are connected by a riser connector. These sections are joined together using the riser connector on board a vessel such as a drilling rig, as the riser is lowered towards a subsea wellhead. Each riser joint normally comprises a main cylindrical pipe, and at least one external auxiliary, smaller diameter, cylindrical pipe (which is generally referred to as an auxiliary line), which is attached to the main pipe so that it is spaced from and extends parallel to the main pipe. Two auxiliary lines are typically connected to the riser, diametrically opposite to one another. More than two auxiliary lines are provided in some cases.

The main pipe forms an annular space around the drill string, along which drilling fluid is returned from the well bore. The auxiliary lines are used to circulate fluids between the vessel and a subsea blowout preventer (BOP) on the wellhead, and may comprise a choke line, a kill line, a booster line, or hydraulic lines.

The riser is suspended from the vessel, and it will be appreciated that, as the wellhead could be located 3000 m or more below the surface of the sea, the weight of the riser and string associated riser connectors can become extremely high. As such, it is known for the resulting load to be shared with the auxiliary lines. This load sharing is achieved by securing the ends of each section of auxiliary line to the riser, via the riser connector. It is, for example, known for the riser connector to comprise annular flanges which extend radially outwardly from the riser connector, one being provided adjacent to each end of each riser joint. The auxiliary riser sections extend between and are secured to the two flanges mounted on one riser joint, with a box and pin joint being located between the two flanges at the ends of adjacent riser joints to provide a fluid flow path between two adjacent auxiliary line sections. The adjacent riser joints are secured together by an internal locking ring which is mounted around the two adjacent riser joints in between the two flanges.

Examples of such riser connectors are described in U.S. Pat. No. 4,043,575 and US 2016/0258562.

FIG. 1 illustrates the riser connection described in U.S. Pat. No. 4,043,575. This shows a joint between the lower end of a first riser joint 10, and the upper end of a second riser joint 12, there being two auxiliary lines 14, 16 mounted on either side of the riser joints 10, 12. The auxiliary lines 14, 16 are supported by flanges 18 and 20, and are connected together via a connection comprising a box 22 and pin 24 which is located between the flanges. The riser joints 10, 12 are secured together using locking ring 25.

FIG. 2 illustrates the riser connection described in US 2016/0258562. Three auxiliary lines 26, 28, 30 are in this case shown mounted on the flanges 32, 34, the sections of auxiliary line attached to each of the two adjacent riser joints being connected by a box 36, 38, 40 and pin 42, 44, 46 located between the two flanges 32, 34. The riser joints 10, 12 are again secured together using a locking ring 48.

Other riser connector configurations are described in U.S. Pat. No. 4,487,434, GB 2 320 541, WO 2011/104629, and U.S. Pat. No. 4,280,719.

In the type of connector illustrated in FIGS. 1 and 2, the load transfer of a portion of the weight of the riser to the auxiliary lines can cause the flanges to deflect slightly, as illustrated in FIG. 3 in relation to the embodiment of a prior art riser connector described in US 2016/0258562. This causes an angular misalignment of the box and pin connection between the adjacent auxiliary lines and, as a result, there is contact stress and wear at the radially inward edge of the boxes and the radially outward edge of the pins at the radially outward sides of the assembly. Although the degree of the likely deflection is significantly exaggerated in FIG. 3, repeated deflections can, over time, cause significant wear of the box and pin, and this could compromise the integrity of the seal between the adjacent sections of auxiliary line.

In the system described in WO 2011/104629, the adjacent ends of the riser joints are secured together by an external locking ring which surrounds and engages with the outer edges of the two flanges. This may assist in reducing the deflection of the flanges, but the use of such a larger diameter locking ring will have a significant impact on the weight of the riser connector.

GB 2 320 541 describes an additional locking mechanism which is provided to lock the adjacent ends of the auxiliary lines together independently of the locking of the riser joints in order to prevent the adjacent sections of auxiliary line from separating vertically when the connector is subject to bending stresses caused by the pressure of fluid in the riser.

SUMMARY

An aspect of the present invention is to provide an alternative configuration of a riser connector which provides for a load transfer to the auxiliary lines, but in which wear of the box and pin connection between adjacent auxiliary line sections is reduced without significantly increasing the weight of the riser connector.

In an embodiment, the present invention provides a riser assembly which includes a riser having a longitudinal axis and comprising a first riser joint having an end and a second riser joint having an end which is adjacent to the end of the first riser joint, an auxiliary line, a first flange and a second flange. The auxiliary line comprises a first auxiliary line section, a second auxiliary line section, and an auxiliary line joint which provides a connection between the first auxiliary line section and the second auxiliary line section. The auxiliary line joint comprises a first joint assembly which is connected to the first auxiliary line section, and a second joint assembly which is connected to the second auxiliary line section. The first joint assembly comprises a bearing surface. The second joint assembly comprises a bearing surface. The first flange extends radially outwardly from an exterior surface of the first riser joint adjacent to the end thereof. The first flange comprises a bearing surface which engages with the bearing surface of the first joint assembly. The second flange extends radially outwardly from an exterior surface of the second riser joint adjacent to the end thereof. The second flange comprises a bearing surface which engages with the bearing surface of the second joint assembly. The bearing surface of the first flange or the bearing surface of the first joint assembly further comprises a first rocker formation which is shaped to provide a point of contact or an area of contact between the bearing surface of the first flange and the bearing surface of the first joint assembly while permitting a relative angular movement therebetween.

BRIEF DESCRIPTION OF THE DRAWINGS

The present invention is described in greater detail below on the basis of embodiments and of the drawings in which.

DETAILED DESCRIPTION

Figure 1:
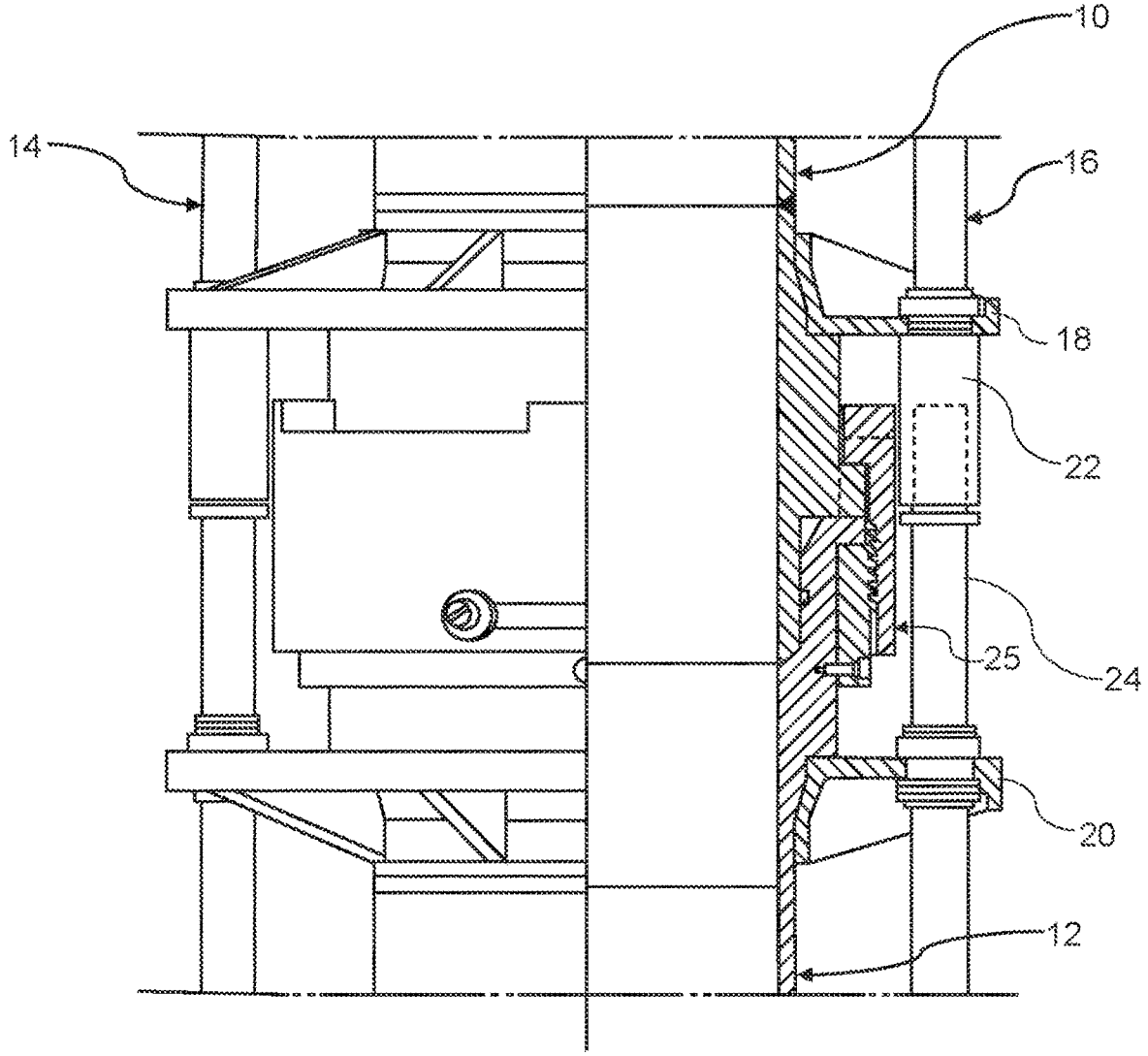
Fig. 1 (Prior Art)
FIG. 1 illustrates the riser connection described in U.S. Pat. No. 4,043,575.
Figure 2:
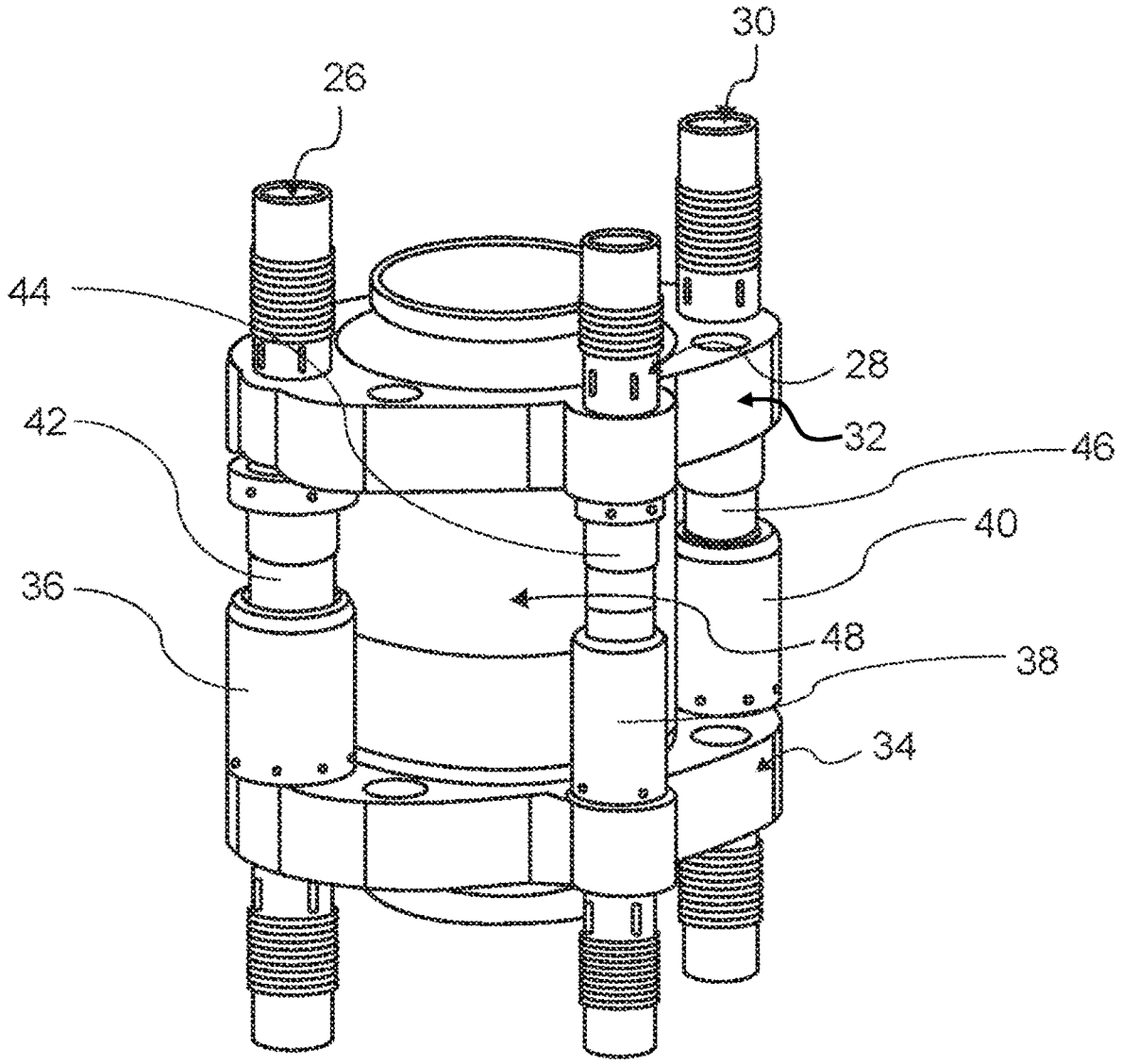
Fig. 2 (Prior Art)
FIG. 2 illustrates the riser connection described in US 2016/0258562.

The invention provides a riser assembly comprising a riser having a longitudinal axis and comprising first riser joint with an end, and a second riser joint with an end which is adjacent to the end of the first riser joint, the riser assembly further comprising an auxiliary line having a first auxiliary line section and a second auxiliary line section which are connected via an auxiliary line joint comprising a first joint assembly connected to the first auxiliary line section and having a bearing surface and a second joint assembly connected to the second auxiliary line section and having a bearing surface, the riser assembly further comprising a first flange which extends radially outwardly from an exterior surface of the first riser joint adjacent to the end thereof and a second flange which extends radially outwardly from an exterior surface of the second riser joint adjacent to the end thereof, the first and second flange each having a bearing surface, the bearing surface of the first flange engaging with the bearing surface of the first joint assembly and the bearing surface of the second flange engaging with the bearing surface of the second joint assembly, wherein one of the bearing surfaces of the first flange and the first joint assembly has a rocker formation which is shaped to provide a point, line or area of contact between the two bearing surfaces while permitting relative angular movement between the two bearing surfaces.

One of the bearing surfaces of the second flange and the second joint assembly advantageously also has a rocker formation which is shaped to provide a point, line or area of contact between the two bearing surfaces while permitting relative angular movement between the two bearing surfaces.

The or each rocker formation may have an arcuate shape in a transverse cross-section.

The or each rocker formation is advantageously shaped to permit a relative angular movement between the two bearing surfaces about an axis which is generally perpendicular to the longitudinal axis of the riser.

The bearing surface of one or both of the first and/or second flange may be provided on an insert which is not integral with the remainder of the flange.

The bearing surface of one or both of the first and/or second joint assembly may be provided on a bearing part which is not integral with the remainder of the joint assembly.

The first flange and the second flange may be separated by an annular space around the ends of the first riser joint and second riser joint, the first joint assembly being connected to the second joint assembly in the annular space.

The first flange has a first side which forms a first end of the annular space and a second opposite side, while the second flange has a first side which forms a second end of the annular space, and a second opposite side. Each bearing surface may in this case form part of the first side of its respective flange.

The first joint assembly may extend through an opening provided in the first flange from the first side to the second side thereof.

The second joint assembly may extend through an opening provided in the second flange from the first side to the second side thereof.

The first auxiliary line section may be connected to the first joint assembly at the second side of the first flange.

The second auxiliary line section may be connected to the second joint assembly at the second side of the second flange.

The first joint assembly may comprise a pin and the second joint assembly may comprise a box, the pin being located in the box to provide the connection between the first auxiliary line section and the second auxiliary line section.

Embodiments of the present invention will now be described, by way of example only, with reference to the drawings.

Figure 4:
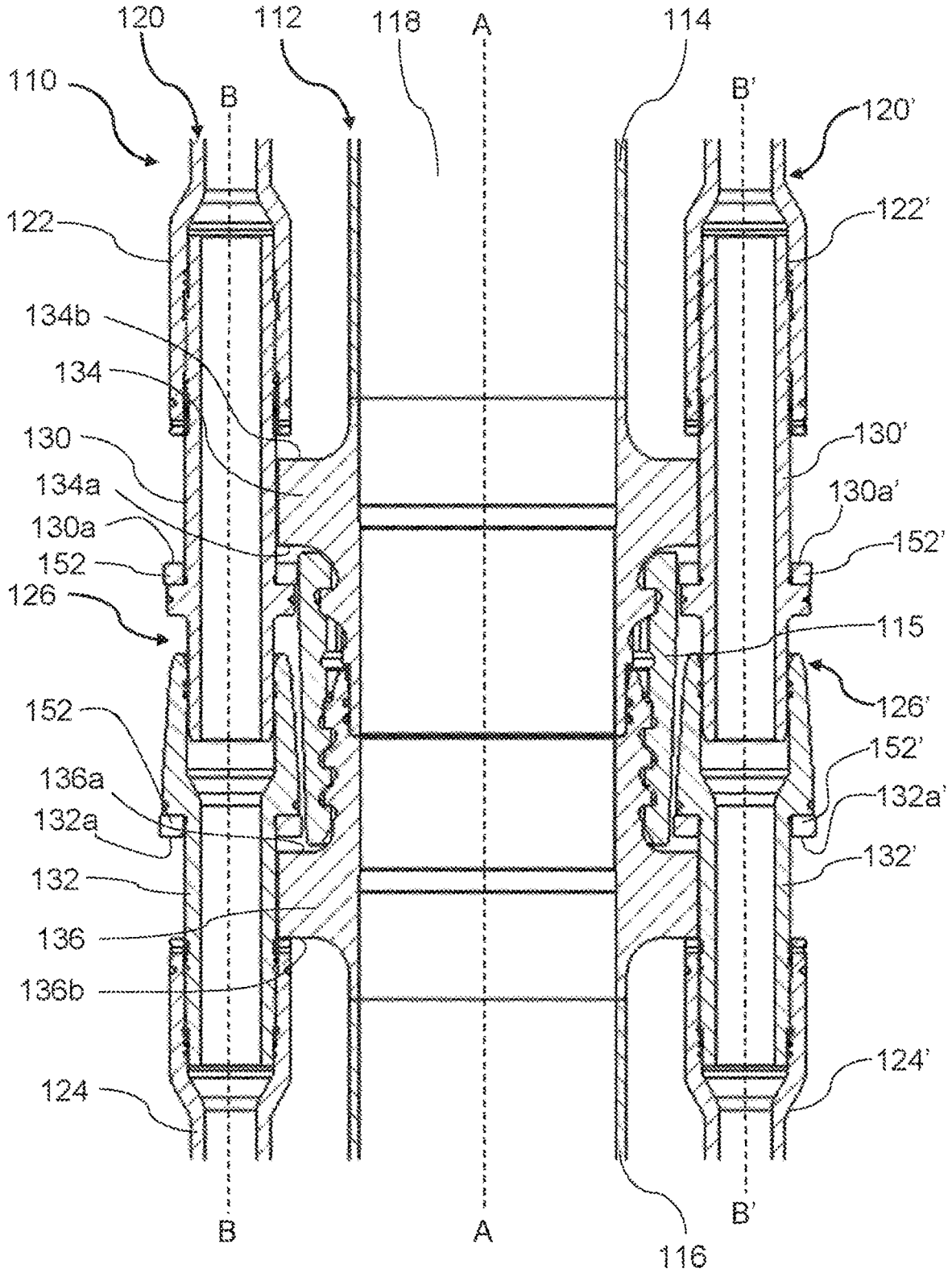
FIG. 4 is an illustration of the longitudinal cross-section through a riser assembly according to the present invention in a plane which includes the longitudinal axis of the riser.
Figure 5:
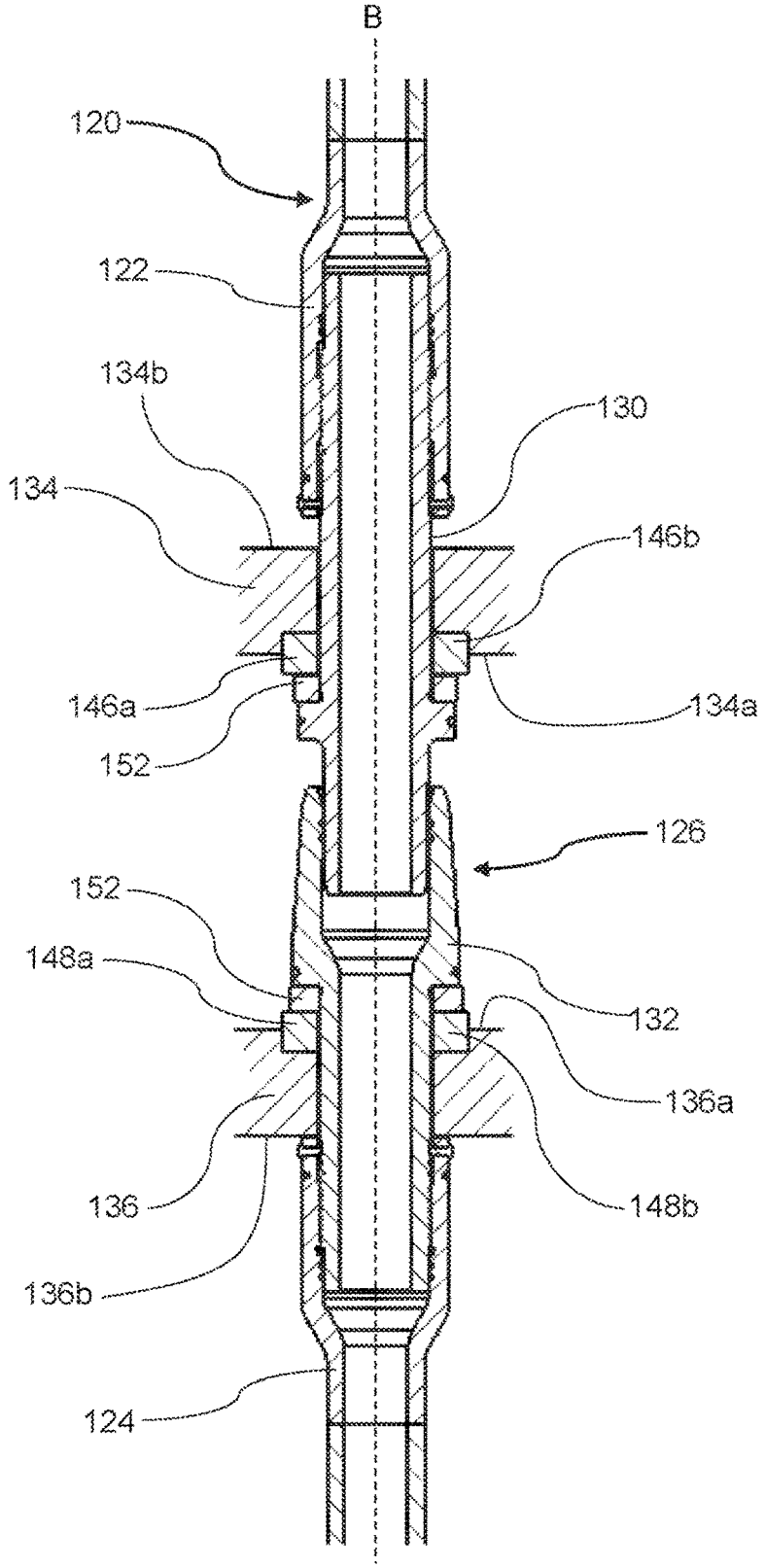
FIG. 5 is a longitudinal cross-section through one of the auxiliary lines and associated flanges of the riser assembly illustrated in FIG. 4, the longitudinal cross-section being in a plane which includes the longitudinal axis of the auxiliary line and which is perpendicular to the plane of the longitudinal cross-section illustrated in FIG. 4.
Figure 6:
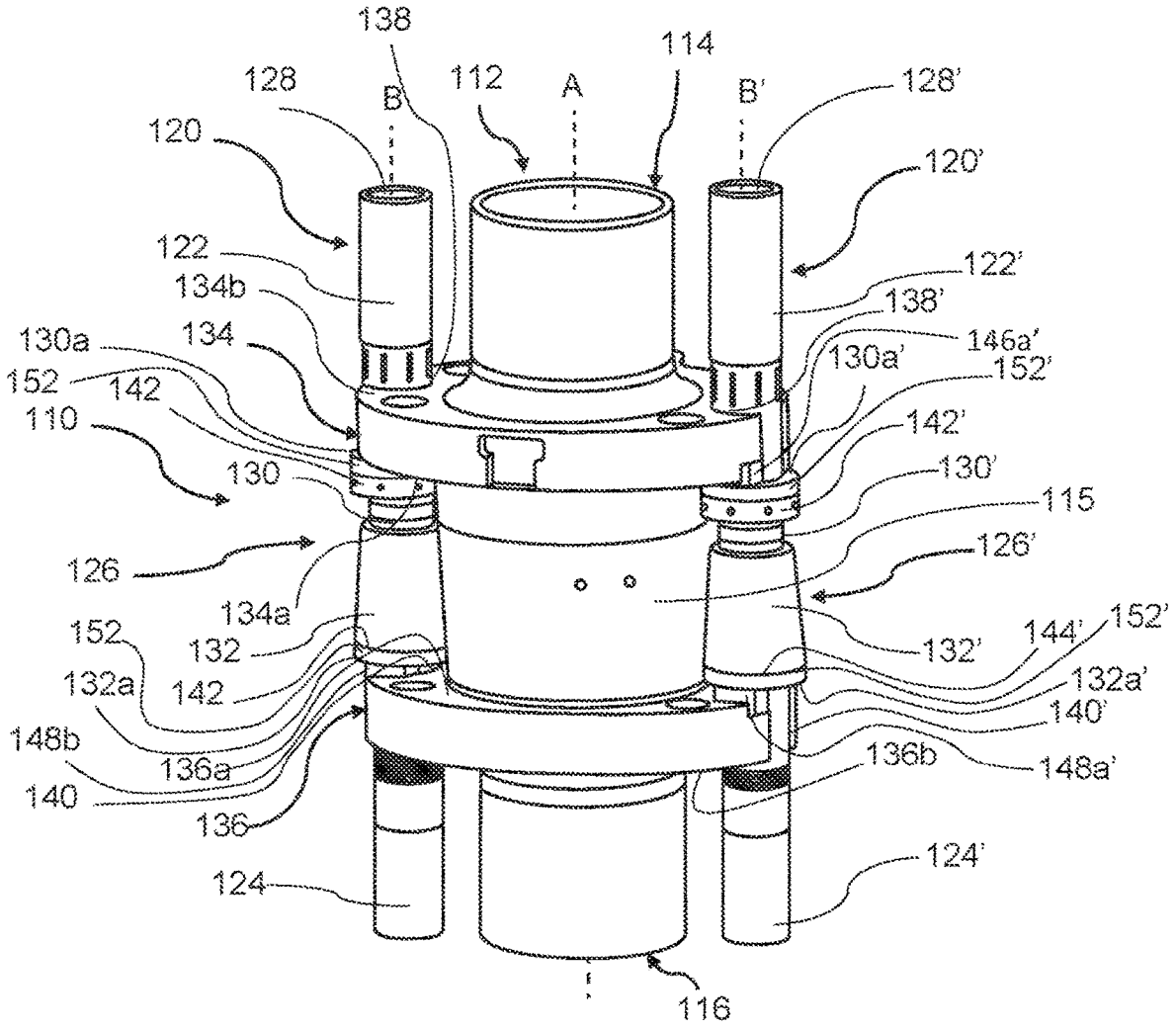
FIG. 6 is a perspective illustration of the riser assembly illustrated in FIG. 4.
Figure 7:
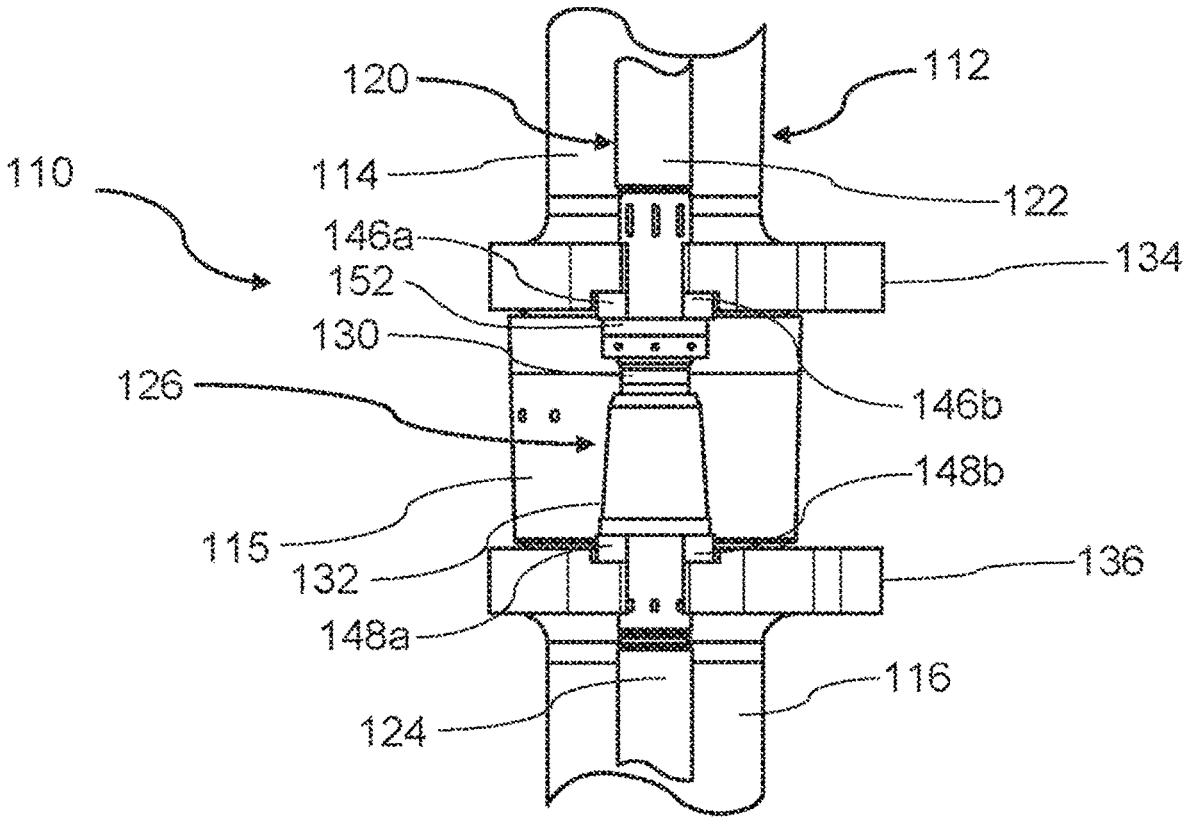
FIG. 7 is a side view of the riser assembly illustrated in FIG. 4.

Referring to FIGS. 4, 5 and 6, there is shown a riser assembly 110 comprising a riser 112 having a first riser joint 114 with an end, and a second riser joint 116 with an end which is adjacent to the end of the first riser joint 114. In this embodiment, the riser joints 114, 116 each have a circular transverse cross-section, and are joined together at their ends to enclose a generally cylindrical main passage 118 with a longitudinal axis A via a locking ring 115 which is located around the exterior of both the ends, as is known to a person skilled in the art. It will be appreciated, however, that the present invention is not restricted to the use of a locking ring 115, and that another method of connecting the ends of the riser joints 114, 116 could be used, such as via breech lock technology or via actuated locking dogs.

The riser assembly 110 further comprises two auxiliary lines 120, 120', each having a first auxiliary line section 122, 122' and a second auxiliary line section 124, 124' which are connected via an auxiliary line joint 126, 126'. In this embodiment, the auxiliary line sections 122, 122', 124, 124' each have a circular transverse cross-section, and are connected to enclose a generally cylindrical passage 128, 128' with a longitudinal axis B, B'. The auxiliary lines 120, 120' are arranged around the exterior of the riser 112 so that the longitudinal axes B, B' of the auxiliary lines 120, 120' lie generally parallel to the longitudinal axis A of the riser 112. In this embodiment, the two auxiliary lines 120, 120' are located diametrically opposite one another relative to the riser 112 so that the riser 112 lies directly between the two auxiliary lines 120, 120'. While two auxiliary lines 120, 120' are provided in this example, this need not be the case. The riser assembly 110 may comprise only one or more than two auxiliary lines.

Each auxiliary line joint 126, 126' may comprise a first joint assembly 130, 130' connected to the first auxiliary line section 122, 122' and a second joint assembly 132, 132' connected to the second auxiliary line section 124', 124'. Each joint assembly has a tubular body which, in this embodiment, has an end with an external thread, and each auxiliary line section 122, 122', 124, 124' is secured to its respective joint assembly 130, 130', 132, 132' by a threaded connection with this external thread.

In this embodiment, each first joint assembly 130, 130' comprises a pin, and each second joint assembly 132, 132' comprises a box, each pin being located in the corresponding box to provide the connection between the first auxiliary line section 122, 122' and the second auxiliary line section 124, 124', as is known from the prior art described above. The pin and box both have a longitudinal axes which coincide when the pin is properly aligned in the box.

The riser assembly 110 further comprises a first flange 134 which extends radially outwardly from an exterior surface of the first riser joint 114 adjacent to the end thereof, and a second flange 136 which extends radially outwardly from an exterior surface of the second riser joint 116 adjacent to the end thereof. The first flange 134 and second flange 136 are therefore separated by an annular space around the ends of the first riser joint 114 and second riser joint 116. The first flange 134 has a first side 134*a* which forms a first end of the annular space and an opposite second side 134*b*, and the second flange 136 has a first side 136*a* which forms a second end of the annular space, and an opposite second side 136*b*. In this example, the first and second sides 134*a*, 134*b*, 136*a*, 136*b* of the flanges 134, 136 extend generally perpendicular to the longitudinal axis A of the main passage 118.

The first joint assemblies 130, 130' each extend through an opening 138, 138' provided in the first flange 134 from the first side 134*a* to the second side 134*b* thereof. Similarly, the second joint assemblies 132, 132' each extend through a corresponding opening 140, 140' provided in the second flange 136 from the first side 136*a* to the second side 136*b* thereof. In this embodiment, the tubular body of each of the joint assemblies 130, 130', 132, 132' extends through the openings 138, 138', 140, 140'. Each first joint assembly 130, 130' connects to its corresponding second joint assembly 132, 132' in the annular space, while the first auxiliary line section 122, 122' of each auxiliary line 120, 120' is connected to the first joint assembly 130, 130' at the second side 134*b* of the first flange 134, and the second auxiliary line section 124,124' of each auxiliary line 120, 120' is connected to the second joint assembly 132, 132' at the second side 136*b* of the second flange 136.

Each joint assembly 130, 130', 132, 132' has a bearing surface 130*a*, 130*a'*, 132*a*, 132*a'* which engages with a corresponding bearing surface provided on one of the flanges 134, 136. In this embodiment, a bearing surface provided on the first side 134*a* of the first flange 134 engages with the bearing surface 130*a*, 130*a'* of each of the first joint assemblies 130, 130', while a bearing surface provided on the first side 136*a* of the second flange 136 engages with the bearing surface 132*a*, 132*a'* of each of the second joint assemblies 132, 132'.

Figure 3:
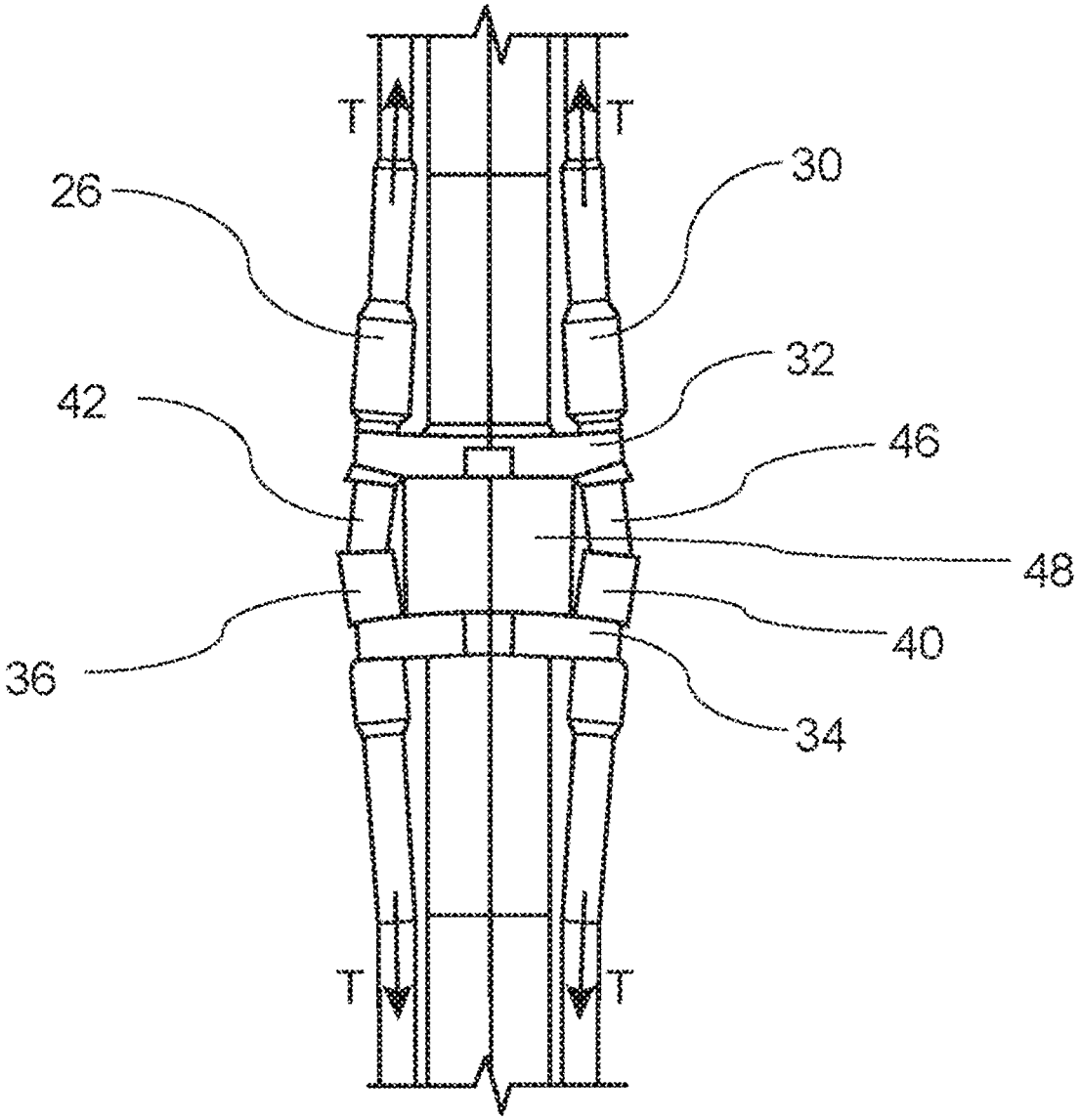
Fig. 3 (Prior Art)
FIG. 3 illustrates the deflection of the flanges in relation to the riser connector described in US 2016/0258562.
Figure 8:
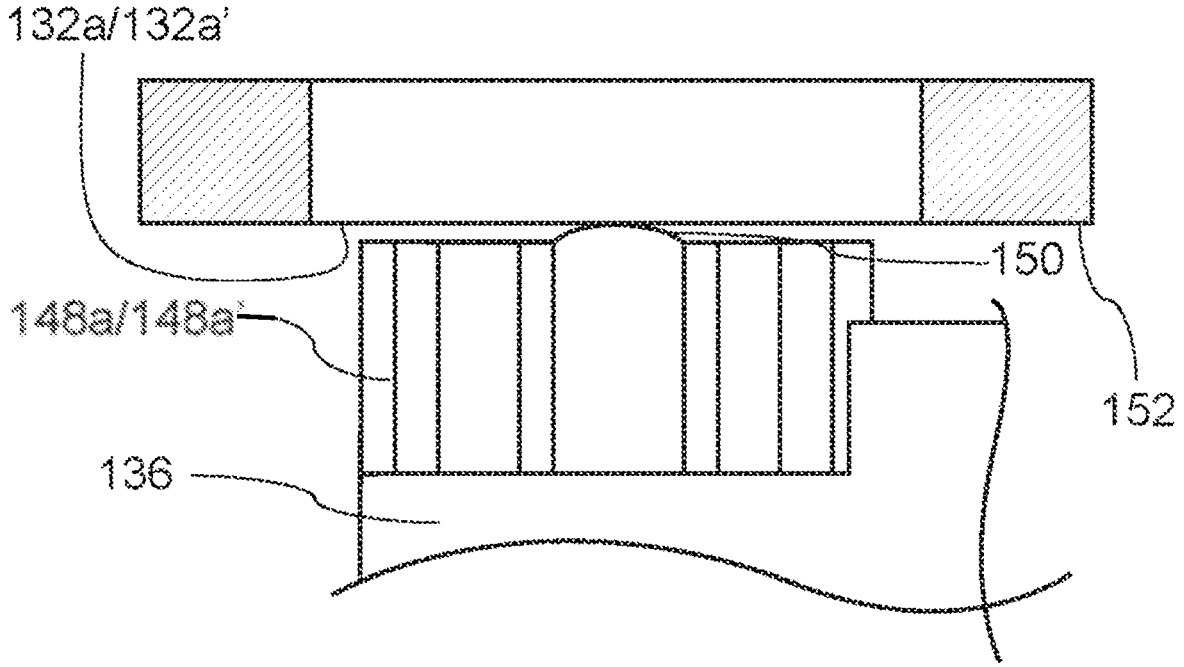
FIG. 8 illustrates a longitudinal cross-section through two of the bearing surfaces in the riser assembly illustrated in FIGS. 4-6, the longitudinal cross-section being in a plane which is parallel to but off-set from the plane of the longitudinal cross-section illustrated in FIG. 5.
Figure 9:
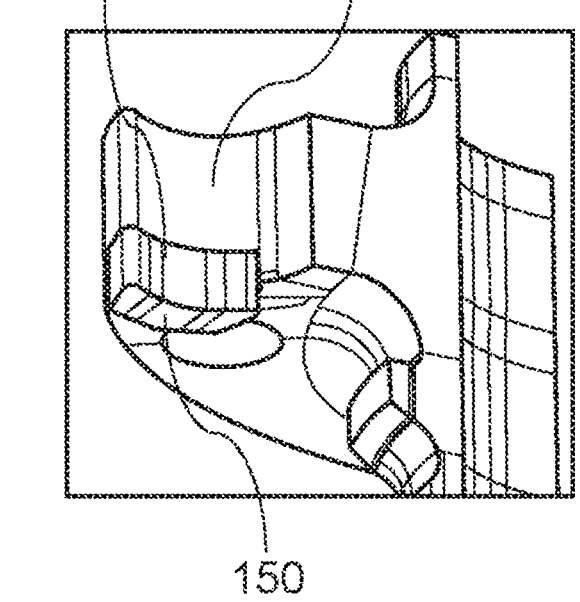
FIG. 9 is a perspective illustration of part of the first flange of the riser assembly illustrated in FIGS. 4-6.
Figure 10:
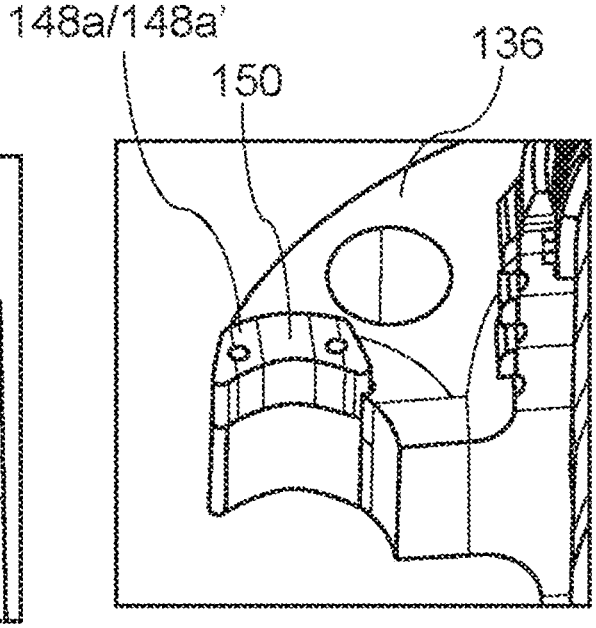
FIG. 10 is a perspective illustration of part of the second flange of the riser assembly illustrated in FIGS. 4-6.

In order to provide that deflection of the flanges 134, 136 as illustrated in FIG. 3 and occurring when the riser assembly 110 is suspended from a drilling vessel is not transmitted to the auxiliary line joint 126, 126', each of the bearing surfaces of the first flange 134 and the second flange 136 has rocker formations 150 which are shaped to provide a point or area of contact with the bearing surfaces 130*a*, 130*a'*, 132*a*, 132*a'*, of each of the joint assemblies 130, 130', 132, 132' while permitting a relative angular movement between the two bearing surfaces. This is best illustrated in FIGS. 8-10, and is not visible in the cross-sections illustrated in FIGS. 4 and 5. The rocker formations 150 are arranged to permit a relative angular movement between the two bearing surfaces about an axis which is generally perpendicular to the longitudinal axis A of the main passage 118. Moreover, in this embodiment, the rocker formations 150 can, for example, also be arranged so that the axis about which there is relative angular movement between the two bearing surfaces is also perpendicular to a line extending between the longitudinal axis A of the main passage 118 of the riser 112, and the longitudinal axis B, B' of the associated auxiliary line 120, 120'.

As such, the angular deflection of the flanges 134, 136 illustrated in FIG. 3 is not transmitted to the auxiliary line joint 126, 126', as the bearing surfaces of the flanges 134, 136 can pivot about the rocker formation 150 relative to the bearing surfaces of the auxiliary line joint 126, 126' during the deformation of the flanges 134, 136 caused by the forces transmitted along the auxiliary lines 120, 120'. The pin can remain properly aligned in the box, and wear of the pin and box resulting from repeated loading of the riser assembly 110 may therefore be reduced.

It will be appreciated that, while in this embodiment, the rocker formations 150 are provided on the bearing surfaces on the flanges 134, 136, this need not be the case. The rocker formations could, instead, be provided on the bearing surfaces 130*a*, 130*a'*, 132*a*, 132*a'* on the joint assemblies 130, 130', 132, 132'. It should also be appreciated that while in this embodiment there is a rocker formation 150 associated with every interface between a bearing surface of a flange 134, 136 and a bearing surface of a joint assembly 130, 130', 132, 132', this need not be the case. For example, there may only be a rocker formation 150 between the bearing surfaces of one of the flanges 134, 36 and the associated bearing surfaces of either the first joint assemblies 130, 130' or the second joint assemblies 132, 132'

The rocker formation 150 may have a curved surface. It may, for example, have an arcuate shape in a transverse cross-section. In this example, the rocker formation 150 corresponds in shape to the curved surface of a portion of a cylinder formed by cutting the cylinder longitudinally along two of its radii. This need not be the case, however, and the rocker formation 150 could, for example be triangular or conical, or have the form of a triangular prism or cone with curved corners.

In this embodiment, the bearing surfaces 130*a*, 130*a*', 132*a*, 132*a*' of both of the first and second joint assemblies 130, 130', 132', 132' are each provided on a bearing part 152, 152' which is not integral with the remainder of the joint assembly 126, 126'. Specifically, in this case, each of these bearing surfaces 130*a*, 130*a*', 132*a*, 132*a*' is provided on an annular insert 152, 152' which is located around the tubular body of the joint assembly 130, 130', 132, 132', and is clamped between the respective flange 134, 136 and a shoulder 142, 142', 144, 144' which is integral with the tubular body of the joint assembly 130, 130', 132, 132'.

Also in this embodiment, the bearing surface of both of the first flange 134 and second flange 136 is provided on inserts 146*a*, 146*b*, 146*a*, 146*b*', 148*a*, 148*b*, 148*a*', 148*b* (not visible in FIG. 4) which are not integral with the remainder of the flange 134, 136. In this example, each flange is provided with a set of such inserts 146*a*, 146*b*, 146*a*', 146*b*', 148*a*, 148*b*, 148*a*', 148*b* for each auxiliary line 120, 120'. In this embodiment, each set comprises two inserts which are positioned generally diametrically opposite to one another around one of the first joint assemblies 130, 130' or second joint assemblies 132, 132'. It will be appreciated, however, that this need not be the case, and that each flange 134, 136 could equally be provided with one insert for each auxiliary line 120, 120'.

The use of such inserts is not essential, but can be advantageous, as they can be made of a higher strength material than the rest of the joint assembly. It will be appreciated that by providing a rocker formation 150, the area of contact between the two engaged bearing surfaces is reduced compared to if the bearing surfaces were both flat. As such, when a force of a given magnitude is applied to the riser assembly 110, the pressure at the area of contact between the bearing surfaces will be much higher. As such, it is desirable to fabricate the bearing surfaces from a material with a high compressive strength to avoid plastic yield, deformation, and flattening of the rocker formation 150. It may not, however, be necessary for the remainder of the flange 134, 136 or joint assembly 130, 130', 132, 132' to be made from such a high strength material and using such a material for all these components could increase the cost and/or weight of the riser assembly 110 more than is necessary. This may be avoided by providing the bearing surfaces on such inserts.

The inserts may be detachable from the joint assembly 130, 130', 132, 132' or flange 134, 136, in order that the inserts may be replaced when worn to such an extent that the desired degree of angular relative movement is no longer provided.

The present invention is not limited to embodiments described herein; reference should be had to the appended claims.

LIST OF REFERENCE NUMERALS

10 First riser joint
12 Second riser joint
14 Auxiliary line
16 Auxiliary line
18 Flange
20 Flange
22 Box
24 Pin
25 Locking ring
26 Auxiliary line
28 Auxiliary line
30 Auxiliary line
32 Flange
34 Flange
36 Box
38 Box
40 Box
42 Pin
44 Pin
46 Pin
48 Locking Ring
110 Riser assembly
112 Riser
114 First riser joint
116 Second riser joint
118 Main passage
120, 120' Auxiliary line
122, 122' First auxiliary line section
124, 124' Second auxiliary line section
126, 126' Auxiliary line joint
128, 128' Generally cylindrical passage
130, 130' First joint assembly
130*a*, 130*a*' Bearing surface
132, 132' Second joint assembly
132*a*, 132*a*' Bearing surface
134 First flange
134*a* First side (of first flange)
134*b* Second side (of first flange)
136 Second flange
136*a* First side (of second flange)
136*b* Second side (of second flange)
138, 138' Opening (in first flange)
140, 140' Opening (in second flange)
142, 142' Shoulder
144, 144' Shoulder
146*a*, 146*a*' Insert
146*b*, 146*b*' Insert
148*a*, 148*a*' Insert
148*b*, 148*b*' Insert
150 Rocker formation
152, 152' Bearing part/annular insert
A Longitudinal axis
B, B' Longitudinal axis

What is claimed is:

1. A riser assembly comprising:
a riser having a longitudinal axis and comprising,
a first riser joint having an end, and
a second riser joint having an end which is adjacent to the end of the first riser joint;
an auxiliary line comprising,
a first auxiliary line section,
a second auxiliary line section, and
an auxiliary line joint which provides a connection between the first auxiliary line section and the second auxiliary line section, the auxiliary line joint comprising,
a first joint assembly which is connected to the first auxiliary line section, the first joint assembly comprising a bearing surface, and
a second joint assembly which is connected to the second auxiliary line section, the second joint assembly comprising a bearing surface;
a first flange which extends radially outwardly from an exterior surface of the first riser joint adjacent to the end thereof, the first flange comprising a bearing surface which engages with the bearing surface of the first joint assembly; and a second flange which extends radially outwardly from an exterior surface of the second riser joint adjacent to the end thereof, the second flange comprising a bearing surface which engages with the bearing surface of the second joint assembly, wherein, the bearing surface of the first flange or the bearing surface of the first joint assembly further comprises a first rocker formation which is shaped to provide a point of contact or an area of contact between the bearing surface of the first flange and the bearing surface of the first joint assembly while permitting a relative angular movement therebetween, the first flange and the second flange are separated by an annular space around the ends of the first riser joint and second riser joint, the first joint assembly is connected to the second joint assembly in the annular space, the annular space has a first end and a second end, the first flange further comprises a first side which forms the first end of the annular space and a second side which is opposite to the first side, the bearing surface of the first flange forming a part of the first side of the first flange, and the second flange further comprises a first side which forms the second end of the annular space and a second side which is opposite to the first side, the bearing surface of the second flange forming a part of the first side of the second flange.

2. The riser assembly as recited in claim 1, wherein the bearing surface of the second flange or the bearing surface of the second joint assembly further comprises a second rocker formation which is shaped to provide a point of contact or an area of contact between the bearing surface of the second flange and the bearing surface of the second joint assembly while permitting a relative angular movement therebetween.

3. The riser assembly as recited in claim 2, wherein at least one of the first rocker formation and the second rocker formation has an arcuate shape in a transverse cross-section.

4. The riser assembly as recited in claim 2, wherein at least one of, the first rocker formation is shaped to provide the relative angular movement between the bearing surface of the first flange and the bearing surface of the first joint assembly which is generally perpendicular to the longitudinal axis of the riser, and the second rocker formation is shaped to provide the relative angular movement between the bearing surface of the second flange and the bearing surface of the second joint assembly which is generally perpendicular to the longitudinal axis of the riser.

5. The riser assembly as recited in claim 2, wherein at least one of, the bearing surface of the first flange is provided on an insert which is not integral with a remainder of the first flange, and the bearing surface of the second flange is provided on an insert which is not integral with a remainder of the second flange.

6. The riser assembly as recited in claim 2, wherein at least one of, the bearing surface of the first joint assembly is provided on a bearing part which is not integral with a remainder of the first joint assembly, and the bearing surface of the second joint assembly is provided on a bearing part which is not integral with a remainder of the second joint assembly.

7. The riser assembly as recited in claim 1, wherein, the first flange further comprises an opening arranged therein, and the first joint assembly extends through the opening of the first flange from the first side to the second side of the first flange.

8. The riser assembly as recited in claim 1, wherein, the second flange further comprises an opening arranged therein, and the second joint assembly extends through the opening of the second flange from the first side to the second side of the second flange.

9. The riser assembly as recited in claim 1, wherein the first auxiliary line section is connected to the first joint assembly at the second side of the first flange.

10. The riser assembly as recited in claim 1, wherein the second auxiliary line section is connected to the second joint assembly at the second side of the second flange.

11. The riser assembly as recited in claim 1, wherein, the first joint assembly further comprises a pin, the second joint assembly further comprises a box, and the pin is arranged in the box so as to provide the connection between the first auxiliary line section and the second auxiliary line section.

12. A riser assembly comprising:

a riser having a longitudinal axis and comprising, a first riser joint having an end, and a second riser joint having an end which is adjacent to the end of the first riser joint;

an auxiliary line comprising, a first auxiliary line section, a second auxiliary line section, and an auxiliary line joint which provides a connection between the first auxiliary line section and the second auxiliary line section, the auxiliary line joint comprising, a first joint assembly which is connected to the first auxiliary line section, the first joint assembly comprising a bearing surface, and a second joint assembly which is connected to the second auxiliary line section, the second joint assembly comprising a bearing surface;

a first flange which extends radially outwardly from an exterior surface of the first riser joint adjacent to the end thereof, the first flange comprising a bearing surface which engages with the bearing surface of the first joint assembly; and a second flange which extends radially outwardly from an exterior surface of the second riser joint adjacent to the end thereof, the second flange comprising a bearing surface which engages with the bearing surface of the second joint assembly, wherein, the bearing surface of the first flange or the bearing surface of the first joint assembly further comprises a rocker formation which is shaped to provide a point of contact or an area of contact between the bearing surface of the first flange and the bearing surface of the first joint assembly while permitting a relative angular movement therebetween, and the rocker formation of the first flange or of the first joint assembly, as the case might be, is provided as an insert which made of a material having a higher compressive strength than a rest of the first flange or of the first joint assembly, as the case might be.

13. A riser assembly comprising:

a riser having a longitudinal axis and comprising, a first riser joint having an end, and a second riser joint having an end which is adjacent to the end of the first riser joint;

an auxiliary line comprising, a first auxiliary line section, a second auxiliary line section, and an auxiliary line joint which provides a connection between the first auxiliary line section and the second auxiliary line section, the auxiliary line joint comprising, a first joint assembly which is connected to the first auxiliary line section, the first joint assembly comprising a bearing surface, and a second joint assembly which is connected to the second auxiliary line section, the second joint assembly comprising a bearing surface;

a first flange which extends radially outwardly from an exterior surface of the first riser joint adjacent to the end thereof, the first flange comprising a bearing surface which engages with the bearing surface of the first joint assembly; and a second flange which extends radially outwardly from an exterior surface of the second riser joint adjacent to the end thereof, the second flange comprising a bearing surface which engages with the bearing surface of the second joint assembly, wherein, the bearing surface of the first flange further comprises a rocker formation provided thereon which is shaped to provide a point of contact or an area of contact between the bearing surface of the first flange and the bearing surface of the first joint assembly while permitting a relative angular movement therebetween, and the rocker formation comprises a shape which corresponds to a curved surface of a portion of a cylinder which is formed by cutting the cylinder longitudinally along two of its radii.

* * * * *